US008638339B2

(12) United States Patent
Choe et al.

(10) Patent No.: US 8,638,339 B2
(45) Date of Patent: Jan. 28, 2014

(54) METHOD FOR CORRECTING PIXEL DATA, AND DISPLAY APPARATUS FOR PERFORMING THE METHOD

(75) Inventors: Weon-Jun Choe, Seoul (KR); Yun-Jae Park, Seoul (KR); Dae-Gwang Jang, Incheon (KR); Kyoung-Phil Kim, Cheonan-si (KR); Sang-Su Han, Seongnam-si (KR)

(73) Assignee: Samsung Display Co., Ltd. (KR)

( * ) Notice: Subject to any disclaimer, the term of this patent is extended or adjusted under 35 U.S.C. 154(b) by 467 days.

(21) Appl. No.: 12/756,801

(22) Filed: Apr. 8, 2010

(65) Prior Publication Data

US 2010/0265262 A1 Oct. 21, 2010

(30) Foreign Application Priority Data

Apr. 16, 2009 (KR) ..... 10-2009-0033264

(51) Int. Cl.
*G09G 5/02* (2006.01)

(52) U.S. Cl.
USPC ..... 345/589; 345/596; 345/601; 345/690; 345/102; 345/84; 345/89

(58) Field of Classification Search
None
See application file for complete search history.

(56) References Cited

U.S. PATENT DOCUMENTS

| | | | | |
|---|---|---|---|---|
| 6,828,954 | B2 * | 12/2004 | Yoshihara et al. | 345/102 |
| 2007/0216616 | A1 | 9/2007 | Stessen et al. | |
| 2008/0278432 | A1 | 11/2008 | Ohshima | |
| 2008/0309611 | A1 | 12/2008 | Yang | |
| 2009/0009456 | A1 | 1/2009 | Oshima | |

FOREIGN PATENT DOCUMENTS

| | | |
|---|---|---|
| CN | 101325043 | 12/2008 |
| EP | 1705636 A1 | 9/2006 |
| JP | 2002-099250 | 4/2002 |
| JP | 2004-177722 | 6/2004 |
| JP | 2005-309338 | 11/2005 |
| JP | 2007-171527 | 7/2007 |
| JP | 2008-507735 | 3/2008 |
| KR | 10-2007-0115772 | 12/2007 |
| KR | 10-2008-0043259 | 5/2008 |

OTHER PUBLICATIONS

European Search Report for EP Application No. 10003933 dated Jun. 29, 2010.

T. Shiga, et al. "49.2: Reduction of LCTV Backlight Power and Enhancement of Gray Scale Capability by Using an Adaptive Dimming Technique", 2003 SID International Symposium, May 20, 2003, Baltimore, Maryland, vol. XXXIV, pp. 1364-1367.

* cited by examiner

*Primary Examiner* — Antonio A Caschera
(74) *Attorney, Agent, or Firm* — Innovation Counsel LLP

(57) ABSTRACT

A method is for correcting pixel data provided to a display apparatus. The display apparatus includes a display panel having a plurality of pixels and a light source module having a plurality of light-emitting blocks. The method includes determining a pixel luminance that is a luminance of light provided to one of the pixels; and generating correction data to correct the pixel data, the correction data being generated based on the pixel luminance and a maximum emission luminance that is a maximum luminance of the light emitted from one of the light-emitting blocks.

20 Claims, 9 Drawing Sheets

FIG. 5

LOOKUP TABLE

| PIXEL LUMINANCE | CORRECTION COEFFICIENT |
|---|---|
| 0 | 0 |
| 16 | 3.20876482 |
| 32 | 2.34156421 |
| 48 | 1.94744226 |
| 64 | 1.70873319 |
| 80 | 1.54391807 |
| 96 | 1.42112662 |
| 112 | 1.32495892 |
| 128 | 1.32495892 |
| 144 | 1.18192874 |
| 160 | 1.12665885 |
| 176 | 1.07889101 |
| 192 | 1.03705301 |
| 208 | 1 |
| 224 | 0.9668756 |
| 240 | 0.93702451 |
| 255 | 0.91155579 |

METHOD FOR CORRECTING PIXEL DATA, AND DISPLAY APPARATUS FOR PERFORMING THE METHOD

CROSS REFERENCE TO RELATED APPLICATIONS

This application claims priority under 35 U.S.C. §119 to Korean Patent Application No. 2009-33264, filed on Apr. 16, 2009 in the Korean Intellectual Property Office (KIPO), the contents of which are herein incorporated by reference in their entirety.

BACKGROUND

1. Technical Field

Embodiments of the present invention generally relate to a method for correcting pixel data and a display apparatus for performing the method. More particularly, embodiments relate to a method for correcting pixel data that may improve display quality, and a display apparatus for performing the method.

2. Related Art

Generally, a liquid crystal display (LCD) apparatus includes an LCD panel to display an image by using light transmittance of liquid crystal molecules and a backlight assembly disposed under the LCD panel to provide the LCD panel with light. The LCD panel includes a first substrate, on which a pixel electrode and a thin-film transistor (TFT) driving the pixel electrode are formed, and a second substrate coupling with the first substrate to receive a liquid crystal layer.

A local dimming method has been developed that uses a light source module divided into a plurality of light-emitting blocks, the luminance of which is individually controlled. The local dimming method adjusts the luminance of the light generated by the light source module and the transmittance of the LCD panel so that an image is displayed. The local dimming method adjusts the transmittance of a pixel according to the luminance of the light provided to the pixel so that power consumption may be decreased and a contrast ratio may be improved.

According to the local dimming method, when a pixel displays a part of the image having the maximum grayscale value, the luminance of the light provided to the pixel is controlled to have a maximum luminance and the transmittance of the pixel is controlled to have a transmittance less than the maximum transmittance. Thus, the pixel may display the part of the image so that it has a luminance corresponding to the maximum grayscale value. The luminance, however, of the light-emitting blocks is individually controlled by the local dimming method so that flicker may be caused by a luminance difference between adjacent light-emitting blocks.

SUMMARY

Embodiments of the present invention provide a method for correcting pixel data that may improve display quality. Embodiments of the present invention also provide a display apparatus for performing the method.

According to one embodiment, in a method for correcting pixel data provided to a display apparatus, the display apparatus including a display panel having a plurality of pixels and a light source module having a plurality of light-emitting blocks, a pixel luminance that is a luminance of light provided to each of the pixels is determined. Correction data to correct the pixel data is generated based on the pixel luminance and a maximum emission luminance that is a maximum luminance of the light emitted from each of the light-emitting blocks.

According to another embodiment, in a method for correcting pixel data, the pixel data controlling the transmittance of light which is generated from a plurality of light-emitting blocks and transmitted through a pixel of a display panel, the transmittance of light through the pixel is decreased when a pixel luminance that is a luminance of the light provided to the pixel is larger than a maximum emission luminance that is a maximum luminance of light generated from each of the light-emitting blocks.

According to another embodiment, a display apparatus includes a display panel, a light source module, and local dimming driving part. The display panel includes a pixel. The light source module includes a plurality of light-emitting blocks to provide light to the display panel. The local dimming driving part is configured to correct pixel data of the pixel to correction data having a grayscale value lower than a grayscale value of the pixel data when a pixel luminance that is a luminance of light provided to the pixel is larger than a maximum emission luminance that is a maximum luminance of light generated from each of the light-emitting blocks. According to another embodiment, a display apparatus includes a display panel, a light source module, a pixel luminance determining part and a correction part. The display panel includes a plurality of pixels. The light source module includes a plurality of light-emitting blocks to provide light to the display panel. The pixel luminance determining part determines a pixel luminance that is a luminance of the light provided to each of the pixels. The correction part generates correction data to correct the pixel data based on the pixel luminance and a maximum emission luminance that is a maximum luminance of the light emitted from each of the light-emitting blocks.

According to one or more embodiments, when a pixel luminance is larger than a maximum emission luminance, the transmittance of a pixel decreases. Thus, a pixel having the same grayscale value may be displayed with the same brightness. In displaying a video, flicker may be prevented when the image changes.

BRIEF DESCRIPTION OF THE DRAWINGS

The above and other features and advantages of embodiments of the present invention will become more apparent by describing, in detail, example embodiments thereof with reference to the accompanying drawings, in which:

FIG. 5 is a schematic diagram illustrating a lookup table (LUT) applied to the pixel luminance determining part of FIG. 1 according to an embodiment.

DETAILED DESCRIPTION

Figure 1:
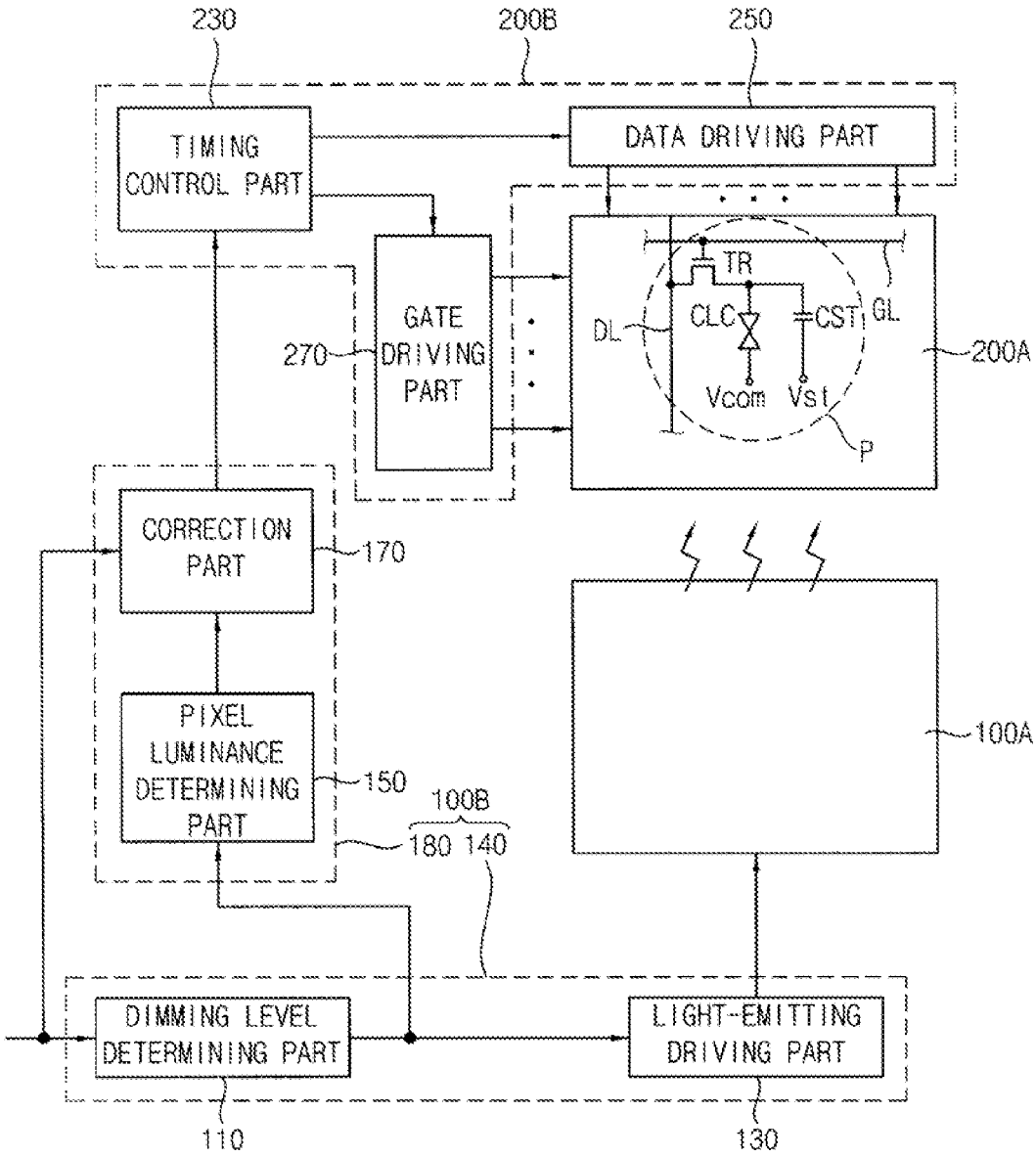
FIG. 1 is a block diagram illustrating a display apparatus according to one embodiment.

Embodiments of the present invention are described more fully hereinafter with reference to the accompanying drawings, in which example embodiments of the present invention are shown. The present invention may, however, be embodied in many different forms and should not be construed as limited to the example embodiments set forth herein. Rather, these example embodiments are provided so that this disclosure will be thorough and complete, and will fully convey the scope of the present invention to those skilled in the art. In the drawings, the sizes and relative sizes of layers and regions may be exaggerated for clarity.

It will be understood that when an element or layer is referred to as being "on," "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numerals refer to like elements throughout. As used herein, the term "and/or" includes any and all combinations of one or more of the associated listed items.

It will be understood that, although the terms first, second, third, etc. may be used herein to describe various elements, components, regions, layers, and/or sections, these elements, components, regions, layers, and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Spatially relative terms, such as "beneath," "below," "lower," "above," "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, for example, the term "below" can encompass both an orientation of above and below. The device may be otherwise oriented (rotated 90 degrees or at other orientations) and the spatially relative descriptors used herein interpreted accordingly.

The terminology used herein is for the purpose of describing particular example embodiments only and is not intended to be limiting of the present invention. As used herein, the singular forms "a," "an", and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Examples of embodiments of the present invention are described herein with reference to cross-sectional illustrations that are schematic illustrations of idealized embodiments (and intermediate structures) of the present invention. As such, variations from the shapes of the illustrations as a result, for example, of manufacturing techniques and/or tolerances, are to be expected. Thus, embodiments of the present invention should not be construed as limited to the particular shapes of regions illustrated herein but are to include deviations in shapes that result, for example, from manufacturing. For example, an implanted region illustrated as a rectangle will, typically, have rounded or curved features and/or a gradient of implant concentration at its edges rather than a discrete change from implanted to non-implanted region. Likewise, a buried region formed by implantation may result in some implantation in the region between the buried region and the surface through which the implantation takes place. Thus, the regions illustrated in the figures are schematic in nature, and their shapes are not intended to illustrate the actual shape of a region of a device and are not intended to limit the scope of the present invention.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein. Hereinafter, embodiments of the present invention will be explained in detail with reference to the accompanying drawings.

Figure 2A:
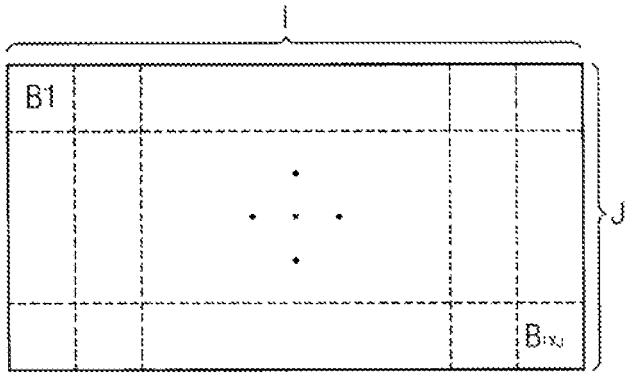
FIG. 2A, FIG. 2B, and FIG. 2C are schematic diagrams illustrating various methods, according to one or more embodiments, of local dimming the light source module of FIG. 1.
Figure 2B:
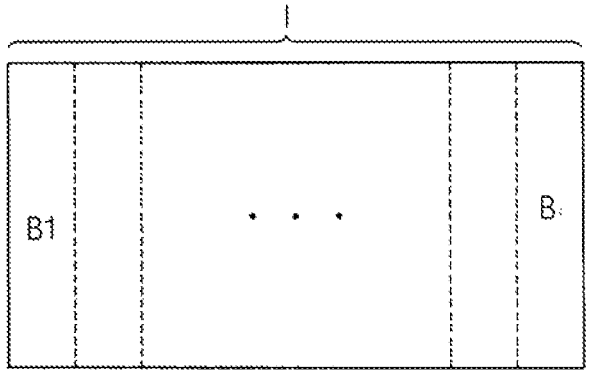
Figure 2C:
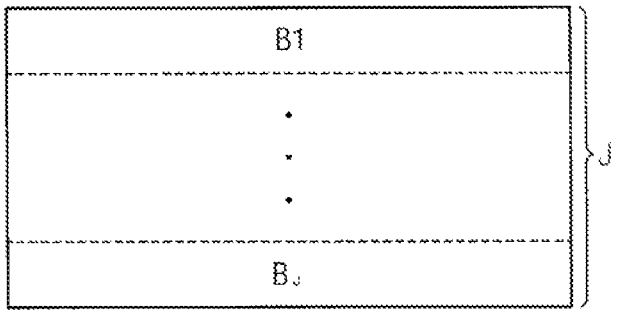

FIG. 1 is a block diagram illustrating a display apparatus according to an embodiment. FIG. 2A, FIG. 2B, and FIG. 2C are schematic diagrams illustrating various methods of local dimming the light source module of FIG. 1 according to one or more embodiments. Referring to FIG. 1, the display apparatus includes a light source module 100A, a local dimming driving part 100B, a display panel 200A, and a panel driving part 200B.

The light source module 100A provides light to the display panel 200A. For example, the light source module 100A includes a plurality of light-emitting blocks B (see FIG. 2A). The light-emitting blocks B are individually driven so that the light source module 100A is driven by the local dimming method. The light-emitting block (for example, B1) has at least one light source. The light source may include, for example, a fluorescent lamp or a light-emitting diode (LED). The light-emitting blocks B of the light source module 100A may have one-dimensional (1-D) or two-dimensional (2-D) local dimming structure as shown in FIG. 2A through FIG. 2C.

For example, referring to FIG. 2A, the light source module 100A is divided by I toward a first direction and J toward a second direction crossing the first direction. Thus, the light source module 100A may have I×J light-emitting blocks B1 . . . BI×J arranged as a 2-D local dimming structure (I and J are natural numbers).

Referring to FIG. 2B, the light source module 100A includes the light-emitting blocks B1, . . . , BI divided by I toward the first direction, or referring to FIG. 2C, the light source module 100A includes the light-emitting blocks B1, . . . , BJ divided by J toward the second direction. Thus, the light source module 100A may have a 1-D local dimming structure. In the local dimming structures as shown by FIG.

2A, FIG. 2B, and FIG. 2C, each of the light-emitting blocks may be influenced by the luminance of adjacent light-emitting blocks.

The local dimming driving part 100B corrects one of the pixel data corresponding to a pixel P to generate correction data having a grayscale value lower than a grayscale value of the pixel data when a pixel luminance, being the luminance of light provided to the pixel P, is more than a maximum emission luminance, being a maximum luminance of light generated from each of the light-emitting blocks. The local dimming driving part 100B individually controls the luminance of the light-emitting blocks. Hereinafter, the local dimming driving part 100B will be described as a plurality of elements, divided according to function. The elements of the local dimming driving part 100B may formed by one module, a plurality of modules grouped with elements of a predetermined number, or modules of various types.

The local dimming driving part 100B includes a light source driving part 140 and a pixel correction part 180. The light source driving part 140 individually controls the luminance of the light-emitting blocks based on an image displayed on the display panel 200A, and includes a dimming level determining part 110 and a light-emitting driving part 130.

The dimming level determining part 110 divides the pixel data corresponding to a frame into a plurality of image blocks corresponding to the light-emitting blocks B of the light source module 100A. One of the pixel data corresponds to the pixel P of the display panel 200A, and each of the image blocks includes the pixel data corresponding to the pixels. The dimming level determining part 110 obtains a plurality of representative values respectively corresponding to the image blocks. The dimming level determining part 110 obtains a representative value of each of the image blocks by using a histogram based on grayscale values of the pixel data corresponding to each of the image blocks. The representative value may be, for example, an average grayscale value or a maximum grayscale value of the pixel data corresponding to the image block. The dimming level determining part 110 determines a plurality of dimming levels respectively corresponding to the image blocks by using the representative values. The dimming level determining part 110 may correct the dimming levels by using a temporal low pass filter (LPF) (not shown) and a spatial low pass filter (LPF) (not shown).

The light-emitting driving part 130 generates a plurality of driving signals for driving the light-emitting blocks B based on the dimming levels respectively corresponding to the light-emitting blocks B. Each of the driving signals is a pulse width modulation (PWM) signal, and each of the dimming levels may correspond to a duty ratio of the PWM signal.

The pixel correction part 180 includes a pixel luminance determining part 150 and a correction part 170. The pixel luminance determining part 150 determines a luminance distribution of light provided to the display panel 200A by using the dimming levels of the light-emitting blocks B and determines a luminance ("pixel luminance") of light provided to one of the pixels. The correction part 170 corrects one of the pixel data by using a correction coefficient α' to generate correction data G'.

A normal method of correcting one of the pixel data may be calculated through the following Equation 1.

$$L_{maxwhite} \cdot \left(\frac{G}{G_{max}}\right)^{\gamma} = L_{pixellight} \cdot \left(\frac{G'}{G_{max}}\right)^{\gamma} \quad \text{(Equation 1)}$$

A maximum white luminance (Lmaxwhite) corresponds to light that is emitted from the light source module 100A driven in the full-white state, Gmax is a maximum grayscale value of one of the pixel data, Lpixellight is the pixel luminance determined from the pixel luminance determining part 150, and γ is a gamma value.

A normal correction coefficient α according to Equation 1 may be calculated through the following Equation 2.

$$G' = \left(\frac{L_{maxwhite}}{L_{pixellight}}\right)^{\frac{1}{\gamma}} \cdot G = a \cdot G \quad \text{(Equation 2)}$$

$$a = \left(\frac{L_{maxwhite}}{L_{pixellight}}\right)^{\frac{1}{\gamma}}.$$

Referring to Equations 1 and 2, a relation between G of the pixel data and the correction data G' is characterized by the normal correction coefficient α. When the pixel luminance (Lpixellight) is substantially the same as the maximum white luminance (Lmaxwhite), the normal correction coefficient α is 1.0. Thus, the pixel data G and the correction data G' are the same as each other; G of the pixel data is not corrected.

For example, in a first case, the pixel P having the transmittance of a white grayscale value is provided a first pixel luminance (Lpixellight1) corresponding to light generated from one of the light-emitting blocks. In a second case, the pixel P having the transmittance of the white grayscale value is provided a second pixel luminance (Lpixellight2) corresponding to light generated from at least two of the light-emitting blocks. In a third case, the pixel P having the transmittance of the white grayscale value is provided a third pixel luminance (Lpixellight3) corresponding to light generated from all the light-emitting blocks. The first pixel luminance (Lpixellight1) is less than the second pixel luminance (Lpixellight2), the second pixel luminance (Lpixellight2) is less than the third pixel luminance (Lpixellight3), and the third pixel luminance (Lpixellight3) is substantially the same as the maximum white luminance (Lmaxwhite).

Referring to the first and second cases, each of the first pixel luminance (Lpixellight1) and the second pixel luminance (Lpixellight2) is less than the maximum white luminance (Lmaxwhite), and the normal correction coefficient α is more than 1.0. Referring to Equation 1, the correction data G' has a high grayscale value that is more than the grayscale value G of the pixel data. G of the pixel data is the white grayscale value, 255 (based on 8 bits), and the correction data G' obtains a high, calculated grayscale value of more than 255. The calculated grayscale value does not, however, display on the pixel P. Therefore, the correction data G' has grayscale value of 255.

Referring to the third case, the third pixel luminance (Lpixellight3) is substantially the same as the maximum white luminance (Lmaxwhite) so that the normal correction coefficient α is 1.0. Referring to Equation 1, the correction data G' is the same grayscale value as the grayscale value 255 of the pixel data G.

Therefore, in the first, second, and third cases, G of the pixel data is corrected to the correction data G' having the same grayscale value, 255, so that the pixel P has the same transmittance. The transmittance of the pixel P is the same, but the first, second, and third pixel luminances (Lpixellight1, Lpixellight2, and Lpixellight3) are different from each other. When the first, second, and third cases are sequentially operated, flicker may be caused by a luminance difference between adjacent light-emitting blocks. In particular, a light change may suddenly be caused at a position where subtitles of a video are displayed, causing flicker.

According to an example embodiment for resolving the foregoing issue, the correction part 170 may calculate a correction coefficient α' aided by the following Equation 3.

$$a' = \left(\frac{L_{minwhite}}{L_{pixellight}}\right)^{\frac{1}{\gamma}} \quad \text{(Equation 3)}$$

The correction coefficient α' may be defined by the maximum emission luminance (Lminwhite) and the pixel luminance (Lpixellight). The maximum emission luminance (Lminwhite) is less than the maximum white luminance (Lmaxwhite). For example, the maximum emission luminance (Lminwhite) is a maximum luminance of light generated from one of the light-emitting blocks.

$$G' = \left(\frac{L_{minwhite}}{L_{pixellight}}\right)^{\frac{1}{\gamma}} \cdot G \quad \text{(Equation 4)}$$

Referring to Equations 3 and 4, a relation between the pixel data G and the correction data G' is characterized by the correction coefficient α'. When the pixel luminance (Lpixellight) is more than the maximum emission luminance (Lminwhite), the correction coefficient α' is less than 1.0. Thus, G of the pixel data is reversely corrected to the correction data G' having a grayscale value lower than the grayscale value G of the pixel data.

For example, in a first case, the pixel P having the transmittance of a white grayscale value is provided to a first pixel luminance (Lpixellight1) corresponding to light generated from one of the light-emitting blocks. In a second case, the pixel P having the transmittance of the white grayscale value is provided to a second pixel luminance (Lpixellight2) corresponding to light generated from at least two of the light-emitting blocks. In a third case, the pixel P having the transmittance of the white grayscale value is provided to a third pixel luminance (Lpixellight3) corresponding to light generated from all the light-emitting blocks. The first, second, and third pixel luminances (Lpixellight1, Lpixellight2, and Lpixellight3) will, for the sake of example, be assumed to be the following. The first pixel luminance (Lpixellight1) is 250, the second pixel luminance (Lpixellight2) is 251, and the third pixel luminance (Lpixellight3) is 255; thus, the maximum emission luminance (Lminwhite) is the same as the first pixel luminance (Lpixellight1), and the maximum white luminance (Lmaxwhite) is substantially the same as the third pixel luminance (Lpixellight3).

In the first case, the correction coefficient α' is 1.0, and the correction data G' is the same grayscale value, 255, as G of the pixel data according to Equations 3 and 4. In the second case, the correction coefficient α' is $(0.99)^C$—where C is 1/γ—according to Equation 3, and the correction data G' is $255\times(0.99)^C$ according to Equation 4. In the third case, the correction coefficient α' is $(0.98)^C$ according to Equation 3, and the correction data G' is $255\times(0.98)^C$ according to Equation 4.

When the transmittance of the pixel P corresponding to the correction data G' in the first case is a first transmittance, the transmittance of the pixel P corresponding to the correction data G' in the second case is a second transmittance less than the first transmittance, and the transmittance of the pixel P corresponding to the correction data G' in the third case is a third transmittance less than the second transmittance.

Therefore, when the pixel luminance (Lpixellight) is more than the maximum emission luminance (Lminwhite), a grayscale value G' of the correction data is corrected to lower than a grayscale value G of the pixel data. Thus, the transmittance of the pixel P may be decreased. Accordingly, the pixel corresponding to one of the pixel data having the same grayscale value may display substantially the same luminance.

A luminance (Ldisplay) of an image displayed on the pixel P by the correction data G' corrected from the correction part 170 may be defined as in the following Equation 5.

$$L_{display} = L_{pixellight} \cdot \left(\frac{G}{G_{max}}\right)^{\gamma} \cdot \text{(Aperture Ratio)} \quad \text{(Equation 5)}$$

The "aperture ratio" is the transmittance of the pixel P.

According to an example embodiment, flicker may be prevented in the local dimming method. Particularly, flicker that is caused by subtitles in a video may be prevented.

The display panel 200A displays an image. For example, the display panel 200A includes a plurality of pixels as m×n. One P of the pixels includes a switching element TR connected to a data line DL and a gate line GL, a liquid crystal capacitor CLC connected to the switching element TR, and a storage capacitor CST connected to the liquid crystal capacitor CLC. The m and n are natural numbers.

The panel driving part 200B includes a timing control part 230, a data driving part 250, and a gate driving part 270. The timing control part 230 provides a timing control signal to each of the data driving part 250 and the gate driving part 270. The timing control part 230 provides the correction data G' received from the pixel correction part 180 to the data driving part 250 based on the timing control signal.

The data driving part 250 converts the correction data G' to an analog data voltage and outputs the analog data voltage to the data line DL of the display panel 200A. The pixel P is electrically connected to the data line DL and has transmittance corresponding to the correction data G'. For example, when the correction data G' is a grayscale value of 255 (based on 8 bits), the transmittance of the pixel P is a maximum (for example, 100%). When the correction data G' is a grayscale value of zero (based on 8 bits), the transmittance of the pixel P is a minimum (for example, 0%). The gate driving part 270 generates the gate signal based on the timing control signal and outputs the gate signal to the gate line GL of the display panel 200A.

Figure 3A:
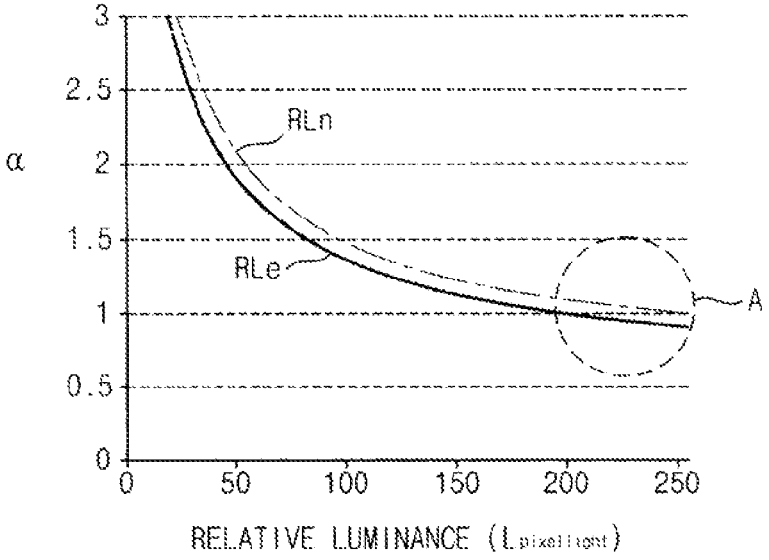
FIG. 3A is a graph illustrating a change of a correction coefficient according to a relative luminance according to an embodiment.
Figure 3B:
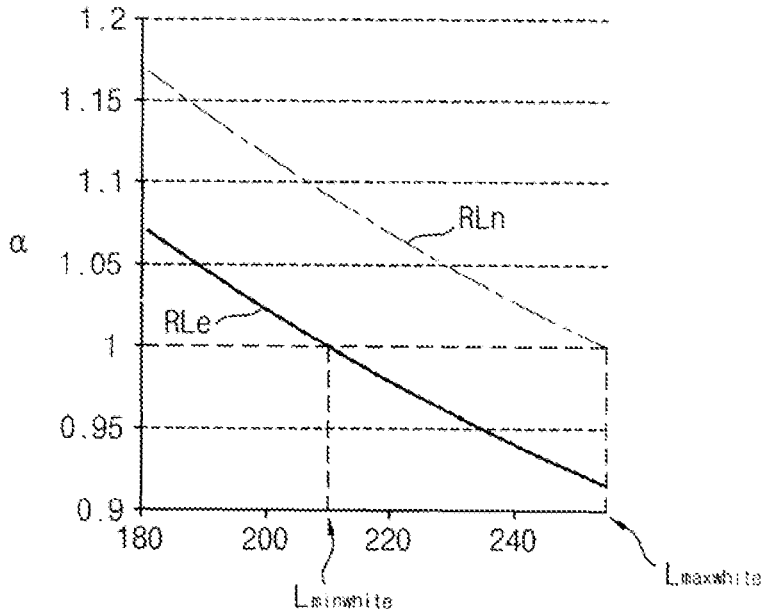
FIG. 3B is an enlarged view illustrating a portion "A" of FIG. 3A according to an embodiment.

FIG. 3A is a graph illustrating a change of a correction coefficient according to a relative luminance according to an embodiment. FIG. 3B is an enlarged view illustrating a portion "A" of FIG. 3A according to an embodiment. Referring to FIG. 3A and FIG. 3B, a first curve (RLe) illustrates a change of the correction coefficient α related to a change of the pixel luminance (Lpixellight) corresponding to the pixel P according to an example embodiment. A second curve (RLn) illustrates a change of a correction coefficient α related to a change of the pixel luminance (Lpixellight) corresponding to the pixel P according to a typical display apparatus.

Referring to the second curve (RLn), when the pixel luminance (Lpixellight) is decreased, the correction coefficient α is increased. When the pixel luminance (Lpixellight) is increased, the correction coefficient α converges on 1.0. When the pixel luminance (Lpixellight) is a maximum white luminance (Lmaxwhite), the correction coefficient α is 1.0.

For example, in the case of which a grayscale value (for example, 250, based on 8 bits) corresponding to the predetermined pixel of the pixel data is less than a maximum grayscale value (for example, 255, based on 8 bits), when the pixel luminance (Lpixellight) of the predetermined pixel is less than the maximum white luminance (Lmaxwhite), the correction coefficient α is more than 1.0. Thus, the correction data has a high grayscale value more than the grayscale value corresponding to the predetermined pixel. Though the pixel luminance (Lpixellight) of light provided to the predetermined pixel is decreased, the grayscale value corresponding to the predetermined pixel is increased. Thus, the transmittance of the predetermined pixel according to the second curve (RLn) is increased so that the predetermined pixel may display a brightness corresponding to an original grayscale value.

In the case of which the grayscale value corresponding to the predetermined pixel is a maximum grayscale value 255 (based on 8 bits), the correction data is 255 and no relation to the change of the pixel luminance (Lpixellight). When the pixel luminance (Lpixellight) of the predetermined pixel is less than the maximum white luminance (Lmaxwhite), the correction coefficient α is more than 1.0. Thus, the correction data has a high grayscale value more than the grayscale value 255 corresponding to the predetermined pixel. The maximum grayscale value capable of being displayed, however, is 255 so that the correction data is 255.

When, however, the pixel luminance (Lpixellight) is the maximum white luminance (Lmaxwhite), the correction data is 255 as the correction coefficient α=1.0. As described above, with the grayscale value of the pixel data being 255, when the pixel luminance (Lpixellight) is substantially the same as the maximum white luminance (Lmaxwhite) or less than the maximum white luminance (Lmaxwhite), the correction data is 255. Therefore, the transmittance corresponding to the grayscale value 255 is the same as each other in both cases, but the pixel luminance (Lpixellight) is different from each other in the two cases. Thus, the predetermined pixel according to the second curve (RLn) may not display the same brightness corresponding to the same grayscale value so that flicker may be caused.

Referring to the first curve (RLe), the correction coefficient α' is 1.0 when the pixel luminance (Lpixellight) is substantially the same as the maximum emission luminance (Lminwhite). The correction coefficient α' is more than 1.0 when the pixel luminance (Lpixellight) is less than the maximum emission luminance (Lminwhite). The correction coefficient α' is less than 1.0 when the pixel luminance (Lpixellight) is more than the maximum emission luminance (Lminwhite).

For example, when the pixel luminance (Lpixellight) of the predetermined pixel is less than the maximum emission luminance (Lminwhite), the correction data having a grayscale value more than a grayscale value corresponding to the predetermined pixel of the pixel data is obtained by the correction coefficient α' being more than 1.0. When the pixel luminance (Lpixellight) is substantially the same as the maximum emission luminance (Lminwhite), the correction data having the same grayscale value as the grayscale value corresponding to the predetermined pixel of the pixel data is obtained by the correction coefficient α' being 1.0. When the pixel luminance (Lpixellight) is more than the maximum emission luminance (Lminwhite), the correction data having a grayscale value less than the grayscale value corresponding to the predetermined pixel of the pixel data is obtained by the correction coefficient α' being less than 1.0. Therefore, the grayscale value of the pixel data is corrected according to the pixel luminance (Lpixellight) so that the predetermined pixel may display a brightness corresponding to an original grayscale value. The grayscale value corresponding to the predetermined pixel controls the transmittance of the predetermined pixel.

Additionally, according to the first curve (RLe), though the grayscale value of the pixel data is a maximum grayscale value 255, the grayscale value of the pixel data is corrected according to the pixel luminance (Lpixellight). Thus, the predetermined pixel may display a brightness corresponding to the grayscale value 255. For example, when the pixel luminance (Lpixellight) is more than a maximum emission luminance (Lminwhite), the correction data having a grayscale value less than the grayscale value 255 corresponding to the predetermined pixel of the pixel data is obtained by the correction coefficient α' being less than 1.0. Therefore, when the pixel luminance (Lpixellight) is increased, the transmittance of the predetermined pixel may be decreased. Thus, the predetermined pixel may display a brightness corresponding to the grayscale value 255.

As described above, high grayscale values more than the predetermined grayscale value of total grayscale values may be corrected to the same correction data according to the second curve (RLn), but the total grayscale values may be corrected to the correction data respectively corresponding to the total grayscale values according to the first curve (RLe). Therefore, the display apparatus according to an example embodiment may improve a display quality. Additionally, substantially the same brightness may be displayed according to the same grayscale value so that flicker may be prevented.

Figure 4A:
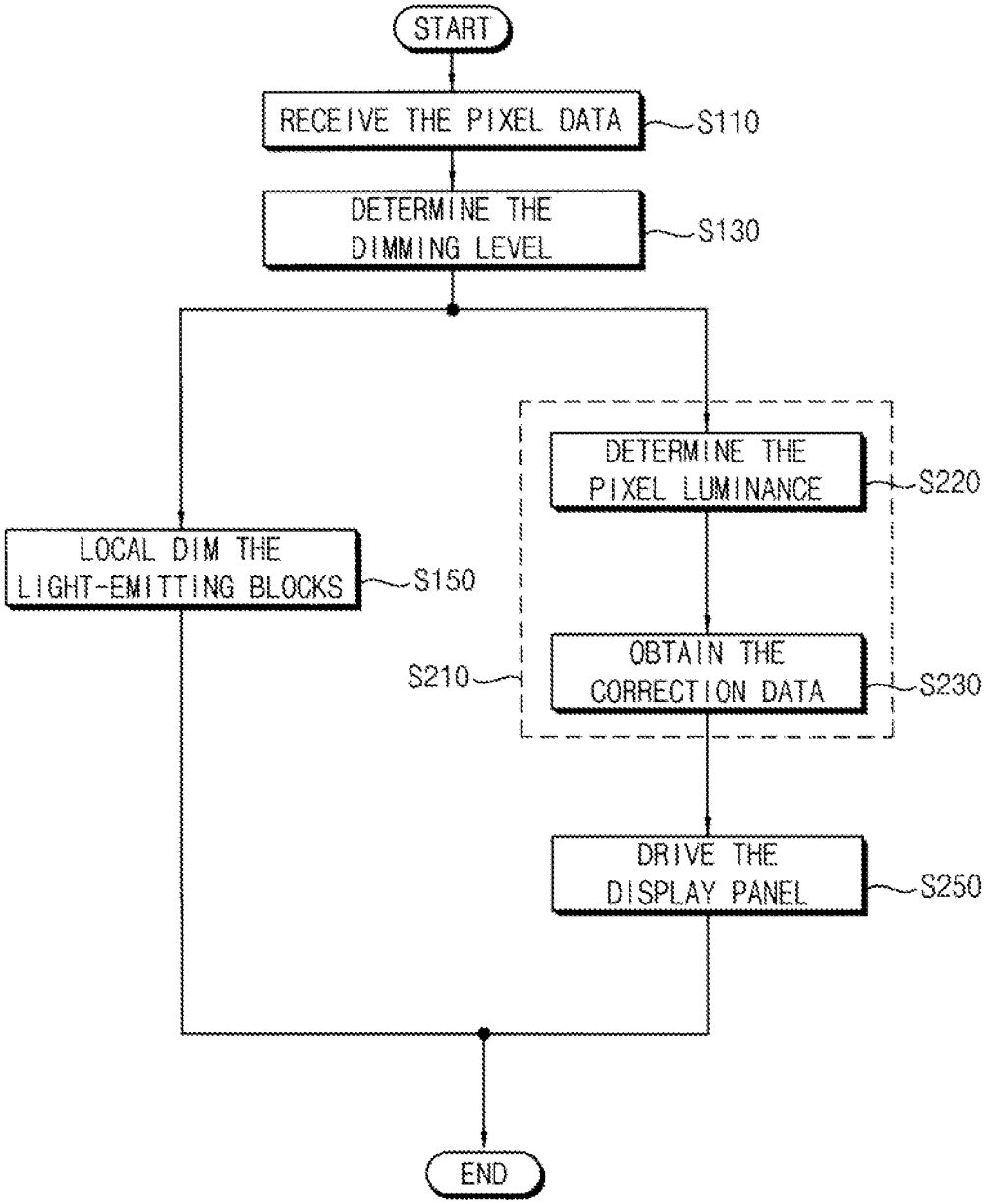
FIG. 4A and FIG. 4B are flowcharts illustrating a method, according to one or more embodiments, for driving the display apparatus of FIG. 1.
Figure 4B:
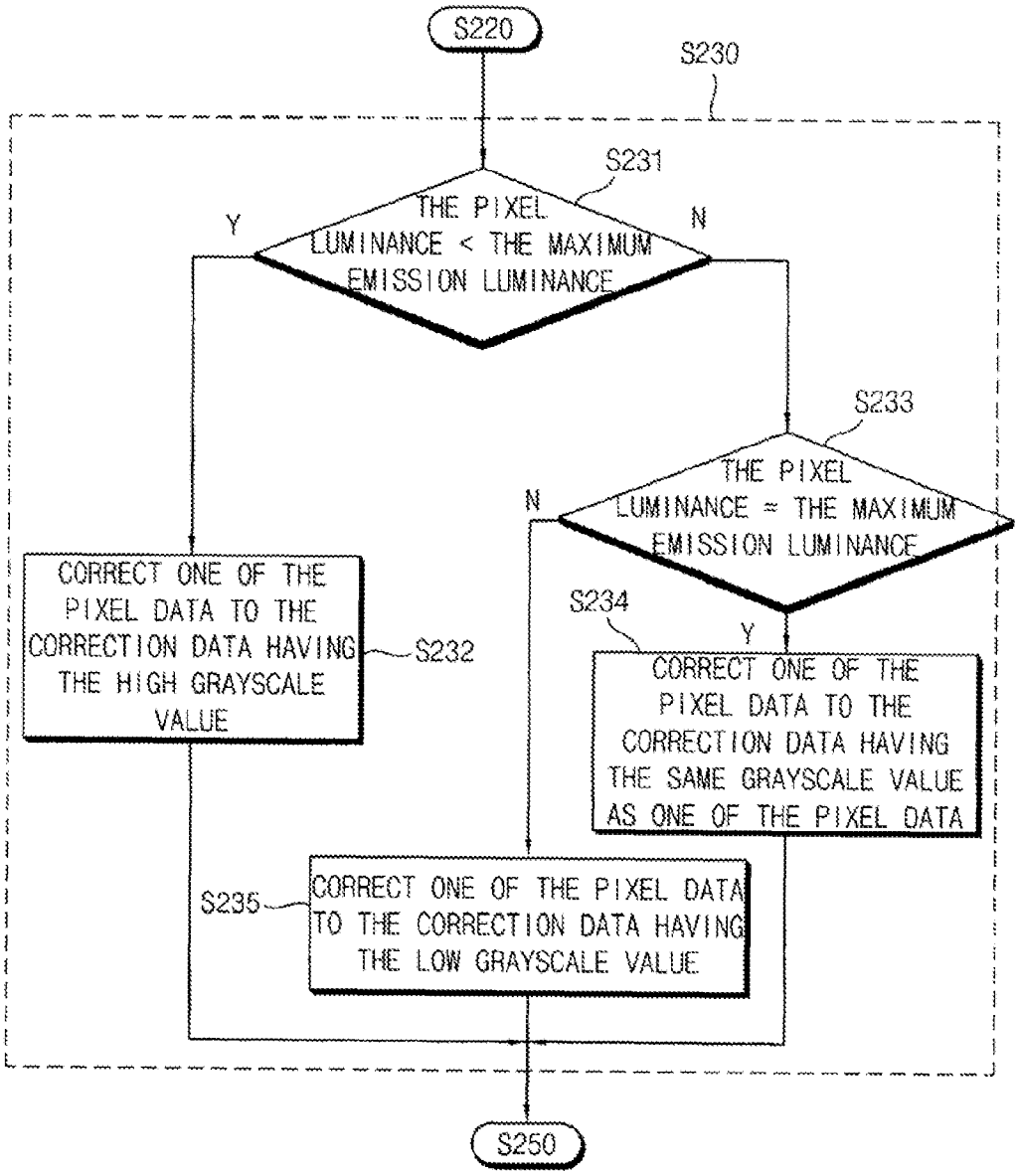

FIG. 4A and FIG. 4B are flowcharts illustrating a method for driving the display apparatus of FIG. 1, according to one or more embodiments. FIG. 5 is a schematic diagram illustrating a lookup table (LUT) applied to the pixel luminance determining part of FIG. 1 according to an embodiment. Referring to FIG. 1, FIG. 4A, and FIG. 4B, the dimming level determining part 110 receives the pixel data (step S110). The dimming level determining part 110 divides the pixel data into the image blocks respectively corresponding to the light-emitting blocks B of the light source module 100A. The dimming level determining part 110 determines the dimming levels respectively corresponding to the image blocks by using the representative values of the image blocks (step S130). The dimming levels may be corrected by using a temporal LPF (not shown) and a spatial LPF (not shown).

The light-emitting driving part 130 generates the driving signals for controlling luminance of the light-emitting blocks based on the dimming levels and outputs the driving signals to the light-emitting blocks B. Thus, the light-emitting blocks B are driven by the local dimming method (step S150).

The pixel correction part 180 corrects the pixel data G to output the correction data G' using the dimming levels (step S210). For example, the pixel luminance determining part 150 determines the luminance distribution of light provided to the display panel 200A by using the dimming levels of the light-emitting blocks B and determines the pixel luminance (Lpixellight) of light provided to the pixels P (step S220).

The correction part 170 calculates the correction data G' corresponding to the pixel data G by using Equations 3 and 4 (step S230). As described above, the correction data G' is calculated by using Equations 3 and 4 according to an example embodiment correction part 170. However, the correction part 170 may obtain the correction data G' by using an LUT such as that shown in FIG. 5, and the LUT stores the correction coefficient α' related to the pixel luminance (Lpixellight). A gamma (γ) applied to the LUT is 2.2, and the maximum emission luminance (Lminwhite) is 208. For example, the LUT stores a plurality of correction coefficients α' respectively related to a plurality of maximum emission luminance (Lminwhite) sampled by 16 grades. In this case, the correction coefficient α' related to the maximum emission luminance (Lminwhite) corresponding to the remaining grades not stored in the LUT may be calculated by using an interpolation. Otherwise, the LUT may store the correction coefficient α' related to the maximum emission luminance (Lminwhite) corresponding to each of all grades that is, for example, from 0 to 255.

Step S230 includes steps S231 to S235, as shown in FIG. 4B. When the pixel luminance (Lpixellight) is less than the maximum emission luminance (Lminwhite) (step S231), the correction coefficient α' is more than 1.0. Thus, the correction part 170 corrects the grayscale value G of one of the pixel data to the correction data G' having a grayscale value more than the grayscale value G of the pixel data (step S232). When the pixel luminance (Lpixellight) is substantially the same as the maximum emission luminance (Lminwhite) (step S233), the correction coefficient α' is 1.0. Thus, the correction part 170 corrects the grayscale value G of one of the pixel data to the same grayscale value (step S234). When the pixel luminance (Lpixellight) is more than the maximum emission luminance (Lminwhite) (step S233), the correction coefficient α' is less than 1.0. Thus, the correction part 170 corrects the grayscale value G of one of the pixel data to the correction data G' having a grayscale value less than the grayscale value G of the pixel data (step S235).

The timing control part 230 provides the correction data G' received from the pixel correction part 180 to the data driving part 250 based on the timing control signal. The data driving part 250 converts the correction data G' to an analog data voltage and outputs the analog data voltage to the data line DL of the display panel 200A. The gate driving part 270 generates the gate signal based on the timing control signal and outputs the gate signal to the gate line GL of the display panel 200A. Therefore, the display panel 200A may display an image corrected according to luminance of the light-emitting blocks B driven by the local dimming method (step S250).

As described above, a luminance change of the display panel may be decreased according to a luminance change of the light-emitting blocks driven by the local dimming method. Thus, in displaying a video, and when an image is changed, flicker may be prevented.

Figure 6A:
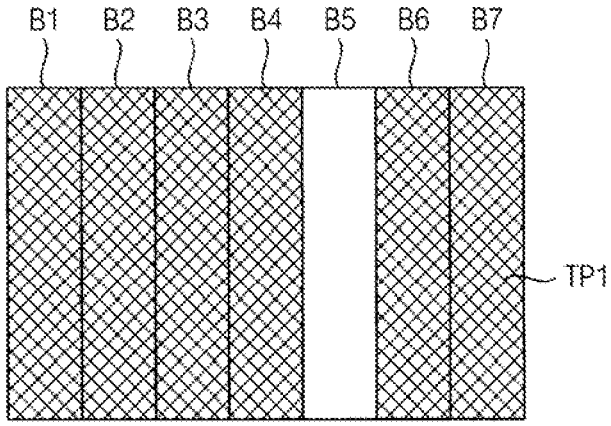
FIG. 6A, FIG. 6B, and FIG. 6C are schematic diagrams illustrating luminance changes of a picture displayed on the display apparatus of FIG. 1 according to one or more embodiments.
Figure 6B:
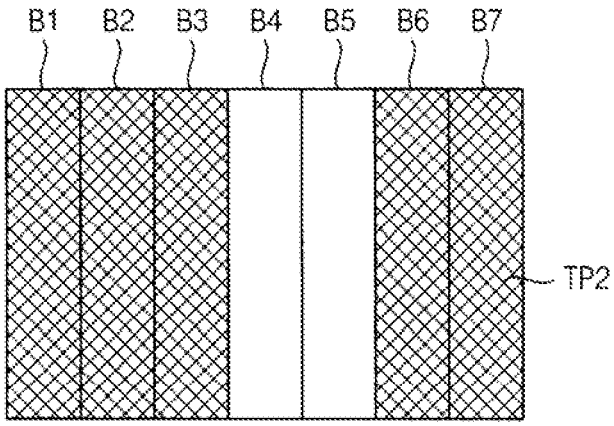
Figure 6C:
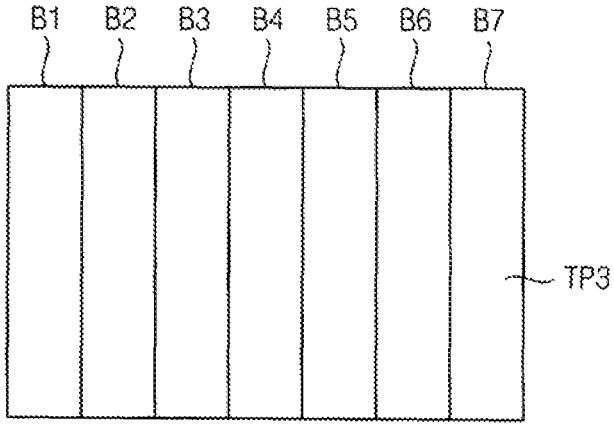

FIG. 6A, FIG. 6B, and FIG. 6C are schematic diagrams illustrating luminance changes of a picture displayed on the display apparatus of FIG. 1 according to one or more embodiments. FIG. 6A is a schematic diagram illustrating a first test pattern TP1 displayed on the display panel when one of 7 light-emitting blocks included in the light source module emits light. FIG. 6B is a schematic diagram illustrating a second test pattern TP2 displayed on the display panel when two adjacent of 7 light-emitting blocks included in the light source module emit light. FIG. 6C is a schematic diagram illustrating a third test pattern TP3 displayed on the display panel when all 7 light-emitting blocks included in the light source module emit light.

In a typical display apparatus, when the first, second, and third test patterns (TP1, TP2, and TP3) are sequentially displayed, the luminance of a pixel having a white grayscale value of the second test pattern (TP2) provided with light from two light-emitting blocks is more than the luminance of a pixel having a white grayscale value of the first test pattern (TP1) provided with light from one light-emitting block. Additionally, the luminance of a pixel having a white grayscale value of the third test pattern (TP3) provided with light from 7 light-emitting blocks is more than the luminance of a pixel having a white grayscale value of the second test pattern (TP2) provided with light from two light-emitting blocks. As described above, the brightness of the pixel having the same grayscale value may be different according to the luminance of adjacent light-emitting blocks so that flicker may be caused.

Hereinafter, the method of driving the display apparatus according to an example embodiment will be described, when the first, second, and third test patterns (TP1, TP2, and TP3) are sequentially displayed.

Referring to FIG. 1 and FIG. 6A, the light source module 100A has a 1-D local dimming structure including first, second, third, fourth, fifth, sixth, and seventh light-emitting blocks B1, B2, B3, B4, B5, B6, and B7. Hereinafter, a method of displaying the first test pattern (TP1) on the display panel 200A opposite to the light source module 100A will be described. A fifth image block (not shown) corresponding to the fifth light-emitting block B5 is an image having the white grayscale value 255 (based on 8 bits), and remaining image blocks (not shown) corresponding to the first, second, third, fourth, sixth, and seventh light-emitting blocks B1, B2, B3, B4, B6, and B7 are a block image having a block grayscale value of zero (based on 8 bits).

The dimming level determining part 110 determines the dimming levels respectively corresponding to the first, second, third, fourth, fifth, sixth, and seventh light-emitting blocks B1, B2, B3, B4, B5, B6, and B7. The fifth light-emitting block B5 has a maximum dimming level, and the remaining light-emitting blocks B1, B2, B3, B4, B6, and B7 have a minimum dimming level. The light-emitting driving part 130 drives the fifth light-emitting block B5 to a maximum luminance based on the maximum dimming level and the remaining light-emitting blocks B1, B2, B3, B4, B6, and B7 to a minimum luminance (that is, the light is turned off) based on the minimum dimming level. For example, the fifth light-emitting block B5 has the maximum emission luminance (Lminwhite). The maximum white luminance (Lmaxwhite) of light that is emitted from all light-emitting blocks of the light source module 100A (that is, the full-white state), is assumed 255. The maximum emission luminance (Lminwhite) of light that is emitted from one of the light-emitting blocks is assumed, for this example, to be 242.

The pixel luminance determining part 150 determines the luminance distribution of light provided to the display panel 200A by using the dimming levels of the light-emitting blocks B1 . . . B7 and determines the pixel luminance (Lpixellight) of light provided to the pixels P. The maximum emission luminance (Lminwhite) of the fifth light-emitting block B5 is 242, and the light-emitting block emitting light in a peripheral area of the fifth light-emitting block B5 may not exist so that the fifth light-emitting block B5 is not influenced by the luminance of adjacent light-emitting blocks. Thus, the pixel luminance (Lpixellight) of a pixel provided with light from the fifth light-emitting block B5 is about 242 that is the maximum emission luminance (Lminwhite) of the fifth light-emitting block B5.

The correction part 170 calculates the correction coefficient α' by using the maximum emission luminance (Lminwhite) and the pixel luminance (Lpixellight) according to Equations 3 and 4, and corrects the pixel data G by using the correction coefficient α'. The correction coefficient α' is $(242/242)^{1/\gamma}=1$, and the correction data G' is substantially the same as the grayscale value 255 of the pixel data G.

Therefore, the correction part 170 generates 255 for the correction data G' of a pixel corresponding to the fifth light-emitting block B5, and outputs the correction data G', 255, to the timing control part 230. The data driving part 250 outputs the data voltage corresponding to the correction data G', 255, to the data line DL electrically connected to the pixel. Thus, the pixel may be driven to the transmittance of about 100%.

Referring to FIG. 1 and FIG. 6B, a method of displaying the second test pattern (TP2) on the display panel 200A will be described. Fourth and fifth image blocks (not shown) respectively corresponding to the fourth and fifth light-emitting blocks B4 and B5 are an image having the white grayscale value 255 (based on 8 bits), and remaining image blocks (not shown) corresponding to the first, second, third, sixth, and seventh light-emitting blocks B1, B2, B3, B6, and B7 are a block image having a block grayscale value of zero (based on 8 bits).

The dimming level determining part 110 determines the dimming levels respectively corresponding to the first, second, third, fourth, fifth, sixth, and seventh light-emitting blocks B1, B2, B3, B4, B5, B6, and B7. The fourth and fifth light-emitting blocks B4 and B5 have the maximum dimming level, and the remaining light-emitting blocks B1, B2, B3, B6, and B7 have the minimum dimming level. The light-emitting driving part 130 drives the fourth and fifth light-emitting blocks B4 and B5 to the maximum luminance based on the maximum dimming level and the remaining light-emitting blocks B1, B2, B3, B6, and B7 to the minimum luminance (that is, the light is turned off) based on the minimum dimming level.

The pixel luminance determining part 150 determines the pixel luminance (Lpixellight) of light provided to each of the pixels. The fourth and fifth light-emitting blocks B4 and B5 are disposed adjacent to each other so that each luminance of the fourth and fifth light-emitting blocks B4 and B5 is influenced by the luminance of the other. Thus, the fourth and fifth light-emitting blocks B4 and B5 adjacent to each other have a white luminance 244 that is more than the maximum emission luminance (Lminwhite) 242 and less than the maximum white luminance (Lmaxwhite) 255. Thus, the pixel luminance determining part 150 determines the pixel luminance (Lpixellight) of a pixel provided with light from the fourth and fifth light-emitting blocks B4 and B5 to be about 244, which is more than the maximum emission luminance (Lminwhite), 242.

The correction part 170 calculates the correction coefficient α' by using the maximum emission luminance (Lminwhite) and the pixel luminance (Lpixellight) according to Equations 3 and 4, and corrects the pixel data G by using the correction coefficient α'. The correction coefficient α' is $(242/244)^{1/\gamma}$, and the correction data G' is $255\cdot(242/244)^{1/\gamma}$. When the gamma, γ, is 2.2, the correction data G' is about 253.

Therefore, the correction part 170 generates 253 for the correction data G' of a pixel corresponding to the fourth and fifth light-emitting blocks B4 and B5, and outputs the correction data G', 253, to the timing control part 230. The data driving part 250 outputs the data voltage corresponding to the correction data G', 253, to the data line DL electrically connected to the pixel. Thus, the pixel may be driven to the transmittance of about 99%.

Referring to FIG. 1 and FIG. 6C, a method of displaying the third test pattern (TP3) on the display panel 200A will be described. In the third test pattern TP3, all image blocks (not shown) corresponding to the first, second, third, fourth, fifth, sixth, and seventh light-emitting blocks B1, B2, B3, B4, B5, B6, and B7 are a white image having the white grayscale value 255 (based on 8 bits).

The dimming level determining part 110 determines the dimming levels respectively corresponding to the first, second, third, fourth, fifth, sixth, and seventh light-emitting blocks B1, B2, B3, B4, B5, B6, and B7 to the maximum dimming level.

The pixel luminance determining part 150 determines the pixel luminance (Lpixellight) of light provided to each of the pixels. The light source module 100A is driven in the full-white state so that the pixel luminance (Lpixellight) is the maximum white luminance (Lmaxwhite) 255.

The correction part 170 calculates the correction coefficient α' by using the maximum emission luminance (Lminwhite) and the pixel luminance (Lpixellight) according to Equations 3 and 4, and corrects the pixel data G by using the correction coefficient α'. The correction coefficient α' is $(242/255)^{1/\gamma}$, and the correction data G' is $255\cdot(242/255)^{1/\gamma}$. When the gamma, γ, is 2.2, the correction data G' is about 249.

Therefore, the correction part 170 generates 249 for the correction data G' of a pixel corresponding to the fourth and fifth light-emitting blocks B4 and B5, and outputs the correction data G', 249, to the timing control part 230. The data driving part 250 outputs the data voltage corresponding to the correction data G', 249, to the data line DL electrically connected to the pixel. Thus, the pixel may be driven to the transmittance of about 97.6%.

As described above, when a pixel luminance (Lpixellight) is more than a maximum emission luminance (Lminwhite), a grayscale value G of pixel data is corrected to correction data G' having a grayscale value less than the grayscale value G of the pixel data. Thus, the transmittance of a pixel corresponding to the pixel data G may be decreased. Therefore, a pixel having the same grayscale value may display the same brightness. In displaying a video, flicker when the image changes may be prevented.

The foregoing is illustrative of embodiments of the present invention and is not to be construed as limiting of the present invention. Although a few example embodiments have been described, those skilled in the art will readily appreciate that many modifications are possible in the example embodiments without materially departing from the novel teachings and advantages of the present invention. Accordingly, all such modifications are intended to be included within the scope of the present invention as defined in the claims. In the claims, means-plus-function clauses are intended to cover the structures described herein as performing the recited function and not only structural equivalents but also equivalent structures. Therefore, it is to be understood that the foregoing is illustrative of embodiments of the present invention and is not to be construed as limited to the specific example embodiments disclosed, and that modifications to the disclosed example embodiments, as well as other example embodiments, are intended to be included within the scope of the appended claims. The present invention is best defined by the following claims, with equivalents of the claims to be included therein.

What is claimed is:

1. A method for correcting pixel data provided to a display apparatus, the display apparatus including a display panel having a plurality of pixels and a light source module having a plurality of light-emitting blocks, the method comprising:

determining a luminance distribution of light provided to an entirety of the display panel;

determining a pixel luminance that is a luminance of light provided to each of the pixels;

generating, using a correction device, correction data to correct the pixel data based on the pixel luminance and a maximum emission luminance that is a maximum luminance of light emitted from each of the light-emitting blocks; and providing a data line on the display panel with the correction data to control a transmittance of the pixel.

2. The method of claim 1, wherein generating the correction data comprises generating the correction data having a grayscale value lower than a grayscale value of the pixel data, when the pixel luminance is more than the maximum emission luminance.

3. The method of claim 1, wherein generating the correction data comprises generating the correction data having a grayscale value higher than a grayscale value of the pixel data, when the pixel luminance is less than the maximum emission luminance.

4. The method of claim 1, wherein generating the correction data comprises generating the correction data having a grayscale value equal to a grayscale value of the pixel data when the pixel luminance is equal to the maximum emission luminance.

5. The method of claim 1, wherein determining the pixel luminance comprises:

determining a plurality of dimming levels of the light-emitting blocks using the pixel data; and determining the pixel luminance using the dimming levels of the light-emitting blocks.

6. The method of claim 1, further comprising: providing the correction data from the correction device to a timing control part of the display apparatus.

7. The method of claim 1, further comprising: providing, based on a timing control signal, the correction data to a data driving part of the display apparatus.

8. The method of claim 1, wherein the maximum emission luminance is less than a maximum white luminance that corresponds to a full-white state associated with the light source module.

9. A method for correcting pixel data, the pixel data controlling a transmittance of light which is generated from a plurality of light-emitting blocks and transmitted through a pixel of a display panel, the method comprising:

determining a luminance distribution of light provided to an entirety of the display panel;

determining a pixel luminance that is a luminance of light provided to each of the pixels; and decreasing, using a driving device, the transmittance of light through the pixel by providing a data line on the display panel with a correction data when the pixel luminance is more than a maximum emission luminance that is a maximum luminance of light generated from each the light-emitting blocks.

10. The method of claim 9, further comprising:

increasing the transmittance of light through the pixel, when the pixel luminance is less than the maximum emission luminance.

11. A display apparatus comprising:

a display panel including a pixel connected to a data line;

a light source module including a plurality of light-emitting blocks to provide light to the display panel;

a local dimming driving part adapted to correct pixel data of the pixel to correction data having a grayscale value lower than a grayscale value of the pixel data when a pixel luminance that is a luminance of light provided to each pixel is more than a maximum emission luminance that is a maximum luminance of light generated from each of the light-emitting blocks; and a data driving part providing the data line with the correction data to control a transmittance of the pixel.

12. The display apparatus of claim 11, wherein the local dimming driving part comprises:

a dimming level determining part adapted to determine dimming levels of the light-emitting blocks using the pixel data;

a pixel luminance determining part adapted to determine a luminance distribution of light provided to an entirety of the display panel and to determine the pixel luminance; and a correction part adapted to generate the correction data using a correction coefficient based on the pixel luminance and the maximum emission luminance.

13. The display apparatus of claim 12, wherein the correction part includes a lookup table (LUT) adapted to store the correction coefficient corresponding to the pixel luminance.

14. The display apparatus of claim 12, wherein the correction part is adapted to generate the correction data having the grayscale value higher than the grayscale value of the pixel data when the pixel luminance is less than the maximum emission luminance, and to generate the correction data having the grayscale value substantially the same as the grayscale value of the pixel data when the pixel luminance is substantially the same as the maximum emission luminance.

15. The display apparatus of claim 12, further comprising a light-emitting driving part adapted to generate driving signals to drive the light-emitting blocks using the dimming levels.

16. A display apparatus comprising:

a display panel including a plurality of pixels, each of the pixels connected to a data line on the display panel;

a light source module including a plurality of light-emitting blocks to provide light to the display panel;

a pixel luminance determining part determining a luminance distribution of light provided to an entirety of the display panel and determining a pixel luminance that is a luminance of the light provided to each of the pixels;

a correction part generating correction data to correct the pixel data based on the pixel luminance and a maximum emission luminance that is a maximum luminance of light emitted from each of the light-emitting blocks; and a data driving part providing the data line with the correction data to control a transmittance of the pixel.

17. The display apparatus of claim 16, wherein the correction part generates the correction data having a grayscale value lower than a grayscale value of the pixel data, when the pixel luminance is more than the maximum emission luminance.

18. The display apparatus of claim 16, wherein the correction part generates the correction data having a grayscale value higher than a grayscale value of the pixel data, when the pixel luminance is less than the maximum emission luminance.

19. The display apparatus of claim 16, wherein the correction part generates the correction data having a grayscale value equal to a grayscale value of the pixel data when the pixel luminance is equal to the maximum emission luminance.

20. The display apparatus of claim 16, further comprising:

a dimming level determining part determining a plurality of dimming levels of the light-emitting blocks using the pixel data, wherein the pixel luminance determining part determines the pixel luminance using the dimming levels of the light-emitting blocks.

* * * * *